US010886614B2

(12) United States Patent
Lee et al.

(10) Patent No.: US 10,886,614 B2
(45) Date of Patent: Jan. 5, 2021

(54) ANTENNA STRUCTURE

(71) Applicant: Chiun Mai Communication Systems, Inc., New Taipei (TW)

(72) Inventors: Cheng-Han Lee, New Taipei (TW); Huo-Ying Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 65 days.

(21) Appl. No.: 16/217,063

(22) Filed: Dec. 12, 2018

(65) Prior Publication Data

US 2019/0181552 A1 Jun. 13, 2019

Related U.S. Application Data

(60) Provisional application No. 62/597,442, filed on Dec. 12, 2017, provisional application No. 62/614,364, filed on Jan. 6, 2018.

(51) Int. Cl.

| | |
|---|---|
| ***H01Q 1/24*** | (2006.01) |
| ***H01Q 5/35*** | (2015.01) |
| ***H01Q 9/28*** | (2006.01) |
| ***H01Q 3/24*** | (2006.01) |
| ***H01Q 9/42*** | (2006.01) |
| ***H01Q 5/335*** | (2015.01) |
| ***H01Q 21/28*** | (2006.01) |
| ***H01Q 13/10*** | (2006.01) |
| ***H01Q 9/30*** | (2006.01) |

(52) U.S. Cl.

CPC ..... *H01Q 5/35* (2015.01); *H01Q 1/243* (2013.01); *H01Q 3/247* (2013.01); *H01Q 5/335* (2015.01); *H01Q 9/285* (2013.01); *H01Q 9/30* (2013.01); *H01Q 9/42* (2013.01); *H01Q 13/10* (2013.01); *H01Q 21/28* (2013.01)

(58) Field of Classification Search

None

See application file for complete search history.

(56) References Cited

U.S. PATENT DOCUMENTS

| | | | | |
|---|---|---|---|---|
| 9,647,323 | B2 * | 5/2017 | Lee | H01Q 1/243 |
| 10,158,384 | B1 * | 12/2018 | Yarga | H01Q 13/103 |
| 2012/0009983 | A1 * | 1/2012 | Mow | H04B 1/40 455/575.7 |
| 2012/0112969 | A1 * | 5/2012 | Caballero | H04M 1/0266 343/702 |
| 2012/0157175 | A1 * | 6/2012 | Golko | H01Q 1/241 455/575.7 |
| 2013/0050046 | A1 * | 2/2013 | Jarvis | H01Q 9/145 343/852 |
| 2015/0372372 | A1 * | 12/2015 | Lee | H01Q 1/243 343/702 |
| 2017/0288298 | A1 * | 10/2017 | Kim | H01Q 1/243 |

(Continued)

FOREIGN PATENT DOCUMENTS

| | | |
|---|---|---|
| CN | 103094717 A | 5/2013 |
| CN | 105305067 A | 2/2016 |

(Continued)

*Primary Examiner* — Trinh V Dinh

(74) *Attorney, Agent, or Firm* — ScienBiziP, P.C.

(57) ABSTRACT

An antenna structure includes a housing and a first feed source. The first feed source is electrically coupled to a first radiating portion of the housing and adapted to provide an electric current to the first radiating portion.

20 Claims, 19 Drawing Sheets

(56) References Cited

U.S. PATENT DOCUMENTS

| | | | | |
|---|---|---|---|---|
| 2018/0026335 | A1* | 1/2018 | Lee | D05C 15/08 |
| 2018/0026355 | A1* | 1/2018 | Lee | F15B 13/044 |
| 2019/0181553 | A1* | 6/2019 | Lee | H01Q 21/28 |
| 2019/0181554 | A1* | 6/2019 | Lee | H01Q 5/335 |
| 2019/0181555 | A1* | 6/2019 | Lee | H01Q 1/243 |

FOREIGN PATENT DOCUMENTS

| | | | |
|---|---|---|---|
| CN | 106299604 | A | 1/2017 |
| CN | 106876897 | A | 6/2017 |
| CN | 107317095 | A | 11/2017 |

* cited by examiner

ANTENNA STRUCTURE

FIELD

The subject matter herein generally relates to antenna structures, and more particularly to an antenna structure of a wireless communication device.

BACKGROUND

As electronic devices become smaller, an antenna structure for operating in different communication bands is required to be smaller.

BRIEF DESCRIPTION OF THE DRAWINGS

Implementations of the present disclosure will now be described, by way of embodiments only, with reference to the attached figures.

DETAILED DESCRIPTION

Figure 1:
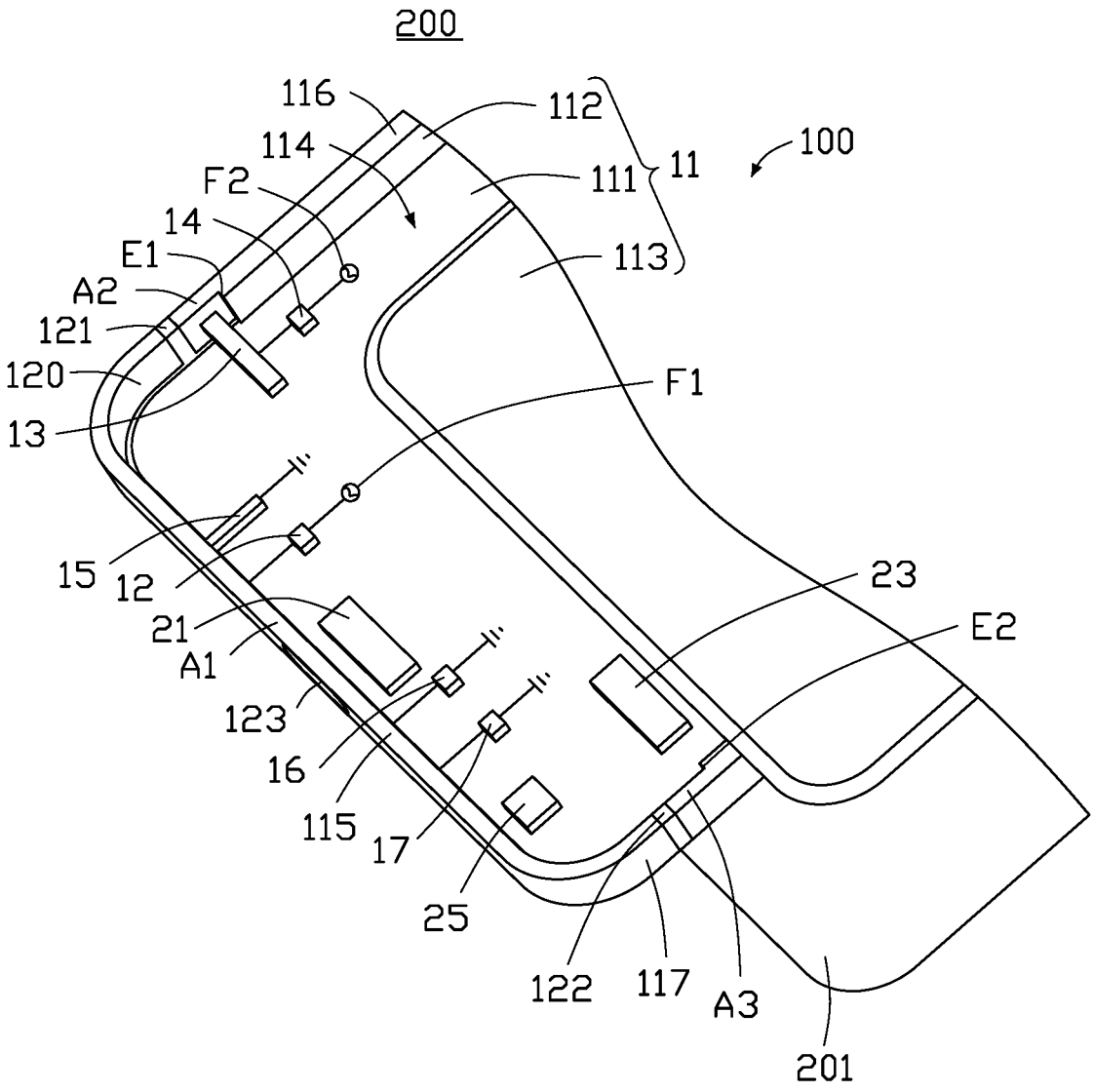
FIG. 1 is a partial isometric view of an embodiment of an antenna structure in a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
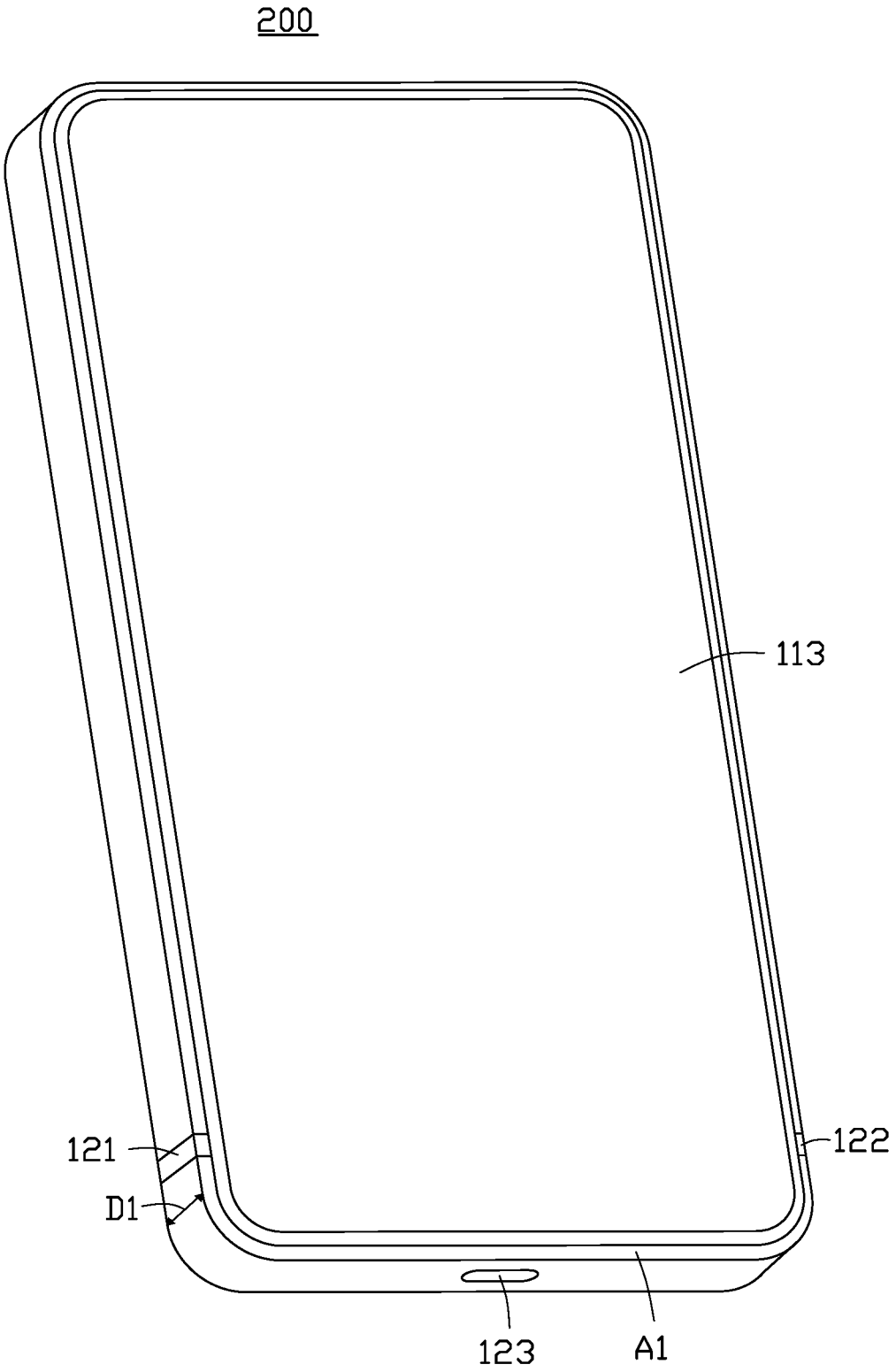
FIG. 2 is an isometric view of the communication device in FIG. 1.

FIG. 1 and FIG. 2 show an embodiment of an antenna structure 100 applicable in a mobile phone, a personal digital assistant, or other wireless communication device 200 for sending and receiving wireless signals.

Figure 3:
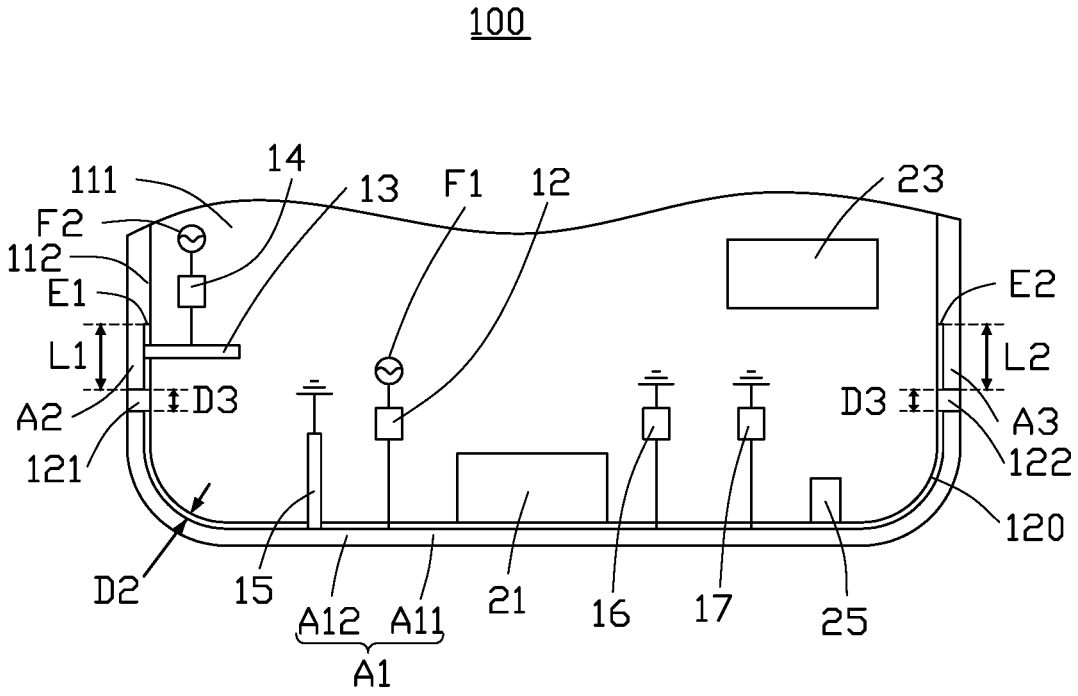
FIG. 3 is a diagram of the antenna structure in FIG. 1.

As shown in FIG. 3, the antenna structure 100 includes a housing 11, a first feed source F1, a first matching circuit 12, a metal portion 13, a second feed source F2, a second matching circuit 14, a short circuit portion 15, a coupling portion 16, and a switching circuit 17.

The housing 11 includes at least a middle frame 111, a border frame 112, and a backplane 113. The middle frame 111 is substantially rectangular. The middle frame 111 is made of metal. The border frame 112 is substantially hollow rectangular and is made of metal. In one embodiment, the border frame 112 is mounted around a periphery of the middle frame 111 and is integrally formed with the middle frame 111. The border frame 112 receives a display 201 mounted opposite the middle frame 111. The middle frame 111 is a metal plate mounted between the display 201 and the backplane 113. The middle frame 111 supports the display 201, provides electromagnetic shielding, and enhances durability of the wireless communication device 200.

The backplane 113 is made of insulating material, such as glass. The backplane 113 is mounted around a periphery of the border frame 112 and is substantially parallel to the display 201 and the middle frame 111. In one embodiment, the backplane 113, the border frame 112, and the middle frame 111 cooperatively define an accommodating space 114. The accommodating space 114 receives components (not shown) of the wireless communication device 200.

The border frame 112 includes at least an end portion 115, a first side portion 116, and a second side portion 117. In one embodiment, the end portion 115 is a bottom end of the wireless communication device 200. The first side portion 116 and the second side portion 117 face each other and are substantially perpendicular to the end portion 115.

In one embodiment, the border frame 112 includes a slot 120, a first gap 121, and a second gap 122. The slot 120 is substantially U-shaped and is defined in an inner side of the end portion 115. In one embodiment, the slot 120 extends along the end portion 115 and extends toward the first side portion 116 and the second side portion 117. The slot 120 insulates the end portion 115 from the middle frame 111.

In one embodiment, the first gap 121 is located on the first side portion 116, and the second gap 117 is located on the second side portion 117. The first gap 121 is defined in the first side portion 116 adjacent to a first endpoint E1 of the slot 120. The second gap 122 is defined in the second side portion 117 adjacent to a second endpoint E2 of the slot 120. The first gap 121 and the second gap 122 substantially face each other. The first gap 121 and the second gap 122 are connected to the slot 120. The slot 120, the first gap 121, and the second gap 122 divide the housing 11 into a first radiating portion A1, a second radiating portion A2, and a third radiating portion A3. In one embodiment, the first radiating portion A1 is a portion of the border frame 112 located between the first gap 121 and the second gap 122. The second radiating portion A2 is a portion of the border frame 112 located between the first gap 121 and the first endpoint E1. The third radiating portion A3 is a portion of the border frame 112 located between the second gap 122 and the second endpoint E2.

In one embodiment, the first radiating portion A1 is insulated from the middle frame 111. An end of the second radiating portion A2 adjacent the first endpoint E1 and an end of the third radiating portion A3 adjacent the second endpoint E2 are coupled to the middle frame 111. The second radiating portion A2, the third radiating portion A3, and the middle frame 111 cooperatively form an integrally formed metal frame.

In one embodiment, the border frame 112 has a thickness D1. The slot 120 has a width D2. Each of the first gap 121 and the second gap 122 has a width D3. D1 is greater than or equal to 2*D3. D2 is less than or equal to half of D3. In one embodiment, the thickness D1 of the border frame 112 is 2-6 mm, the width D2 of the slot 120 is 0.5-1.5 mm. The width D3 of the first gap 121 and the second gap 122 is 1-3 mm.

In one embodiment, the slot 120, the first gap 121, and the second gap 122 are made of insulating material, such as plastic, rubber, glass, wood, ceramic, or the like.

The wireless communication device 200 further includes at least one electronic component, such as a first electronic component 21, a second electronic component 23, and a third electronic component 25. The first electronic component 21 is a universal serial bus (USB) port located within the accommodating space 114. The first electronic component 21 is insulated from the first radiating portion A1 by the slot 120.

The second electronic component 23 is a speaker and is mounted on a side of the first electronic component 21 and is adjacent to the second side portion 117. The second electronic component 23 is spaced 4-10 mm from the slot 120. The third electronic component 25 is a microphone and is mounted within the accommodating space 114. The third electronic component 25 is located between the second electronic component 23 and the slot 120 and is adjacent the second gap 122. In one embodiment, the third electronic component 25 is insulated from the first radiating portion A1 by the slot 120.

In another embodiment, the second electronic component 23 and the third electronic component 25 can be mounted in different locations according to requirements.

In one embodiment, the border frame 112 defines a port 123 in the end portion 115. The port 123 corresponds to the first electronic component 21 so that the first electronic component 21 partially protrudes through the port 123. Thus, a USB device can be inserted in the port 123 to electrically coupled to the first electronic component 21.

In one embodiment, the first feed source F1 is received within the accommodating space 114. One end of the first feed source F1 is electrically coupled to a side of the first radiating portion A1 adjacent to the first gap 121 through the first matching circuit 12 for feeding a current signal to the first radiating portion A1. The first matching circuit 12 provides a matching impedance between the first feed source F1 and the first radiating portion A1.

In one embodiment, the first feed source F1 divides the first radiating portion A1 into a first radiating section A11 and a second radiating section A12. A portion of the border frame 112 between the first feed source F1 and the second gap 122 is the first radiating section A11. A portion of the border frame 112 between the first feed source F1 and the first gap 121 is the second radiating section A12. In one embodiment, the first feed source F1 is not positioned in the middle of the first radiating portion A1. Thus, a length of the first radiating section A11 and a length of the second radiating section A12 are not equal.

The metal portion 13 is made of metal and is mounted within the accommodating space 114. One end of the metal portion 13 is electrically coupled to the second radiating portion A2, and a second end of the metal portion 13 extends along the slot 120.

The second feed source F2 and the second matching circuit 14 are mounted within the accommodating space 114. One end of the second feed source F2 is electrically coupled to the metal portion 13 through the second matching circuit 14 for feeding current signals to the metal portion 13. The second matching circuit 14 provides a matching impedance between the second feed source F2 and the metal portion 13.

The short circuit portion 15 is made of metal and is mounted within the accommodating space 114. One end of the short circuit portion 15 is electrically coupled to an end of the second radiating section A12 adjacent to the first feed source F1, and a second end of the short circuit portion 15 is coupled to ground.

The coupling portion 16 may be an inductor, a capacitor, or a combination of the two. In one embodiment, the coupling portion 16 is an inductor. One end of the coupling portion 16 is electrically coupled to an end of the first radiating section A11 adjacent to the first electronic component 21, and a second end of the coupling portion 16 is coupled to ground.

Figure 4:
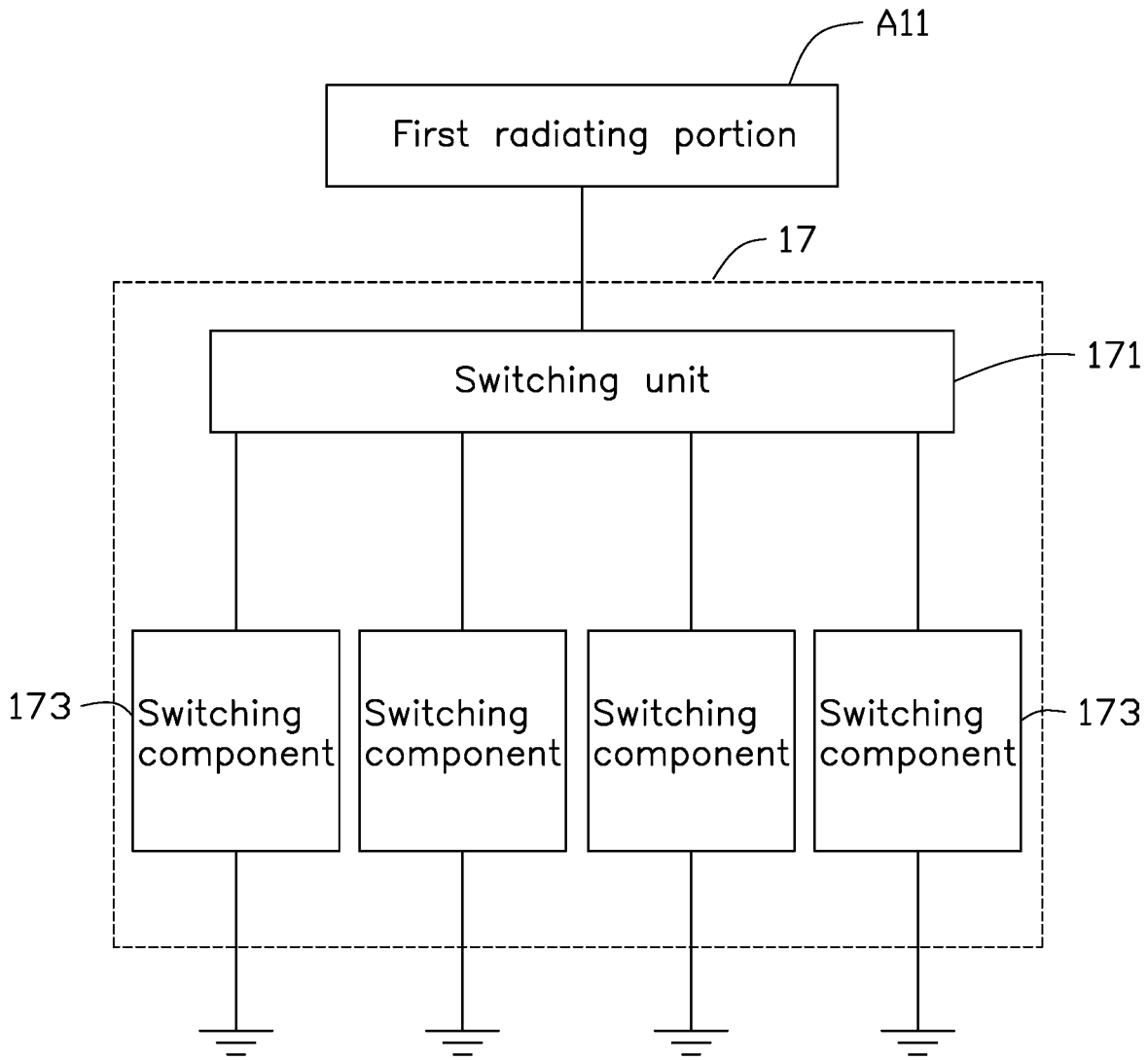
FIG. 4 is a block diagram of a switching circuit.

FIG. 4 shows the switching circuit 17. In one embodiment, the switching circuit 17 is mounted within the accommodating space 114 and is located between the coupling portion 16 and the third electronic component 25. One end of the switching circuit 17 extends beyond the slot 120 to electrically coupled to the first radiating section A11. A second end of the switching circuit 17 is coupled to ground. The switching circuit 17 includes a switching unit 171 and a plurality of switching components 173. The switching unit 171 is electrically coupled to the first radiating section A11. Each switching component 173 may be an inductor, a capacitor, or a combination of the two. The switching components 173 are coupled together in parallel. One end of each of the switching components 173 is electrically coupled to the switching unit 171, and a second end of each of the switching components 173 is coupled to ground. The first radiating portion A1 includes a plurality of ground points for coupling to ground, such as through the short circuit portion 15, the coupling portion 16, or the switching circuit 17.

Figure 5:
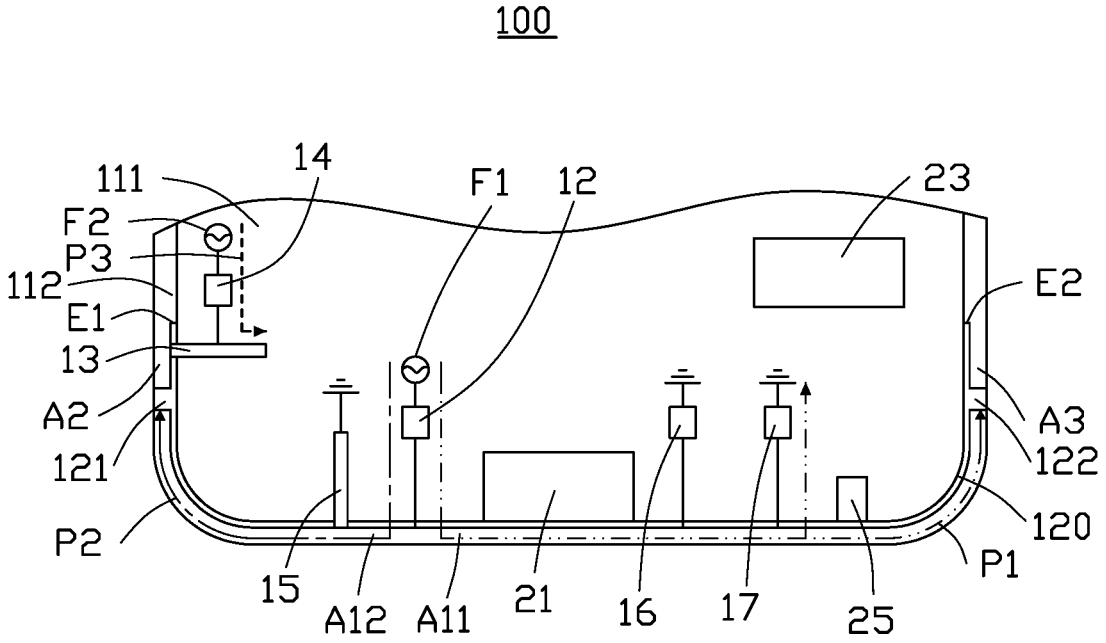
FIG. 5 is a diagram of current paths of the antenna structure in FIG. 3.

As shown in FIG. 5, when the first feed source F1 supplies an electric current, the electric current from the first feed source F1 flows through the first matching circuit 12 and the first radiating section A11 in sequence toward the second gap 122 along a current path P1. Thus, the first radiating section A11 forms a planar inverted F-shaped antenna (PIFA) to excite a first resonant mode and generate a radiation signal in a first frequency band.

The electric current from the first feed source F1 can also flow through the first matching circuit 12 and the second radiating section A12 toward the first gap 121 along a current path P2. Thus, the second radiating section A12 forms an inverted F-shaped antenna (IFA) to excite a second resonant mode and generate a radiation signal in a second frequency band.

When the second feed source F2 supplies an electric current, the electric current from the second feed source F2 flows through the second matching circuit 14 and the metal portion 13 along a current path P3. Thus, the metal portion 13 forms a PIFA antenna to excite a third resonant mode and generate a radiation signal in a third frequency band.

In one embodiment, the first resonant mode is a long term evolution advanced (LTE-A) low-frequency band, the second resonant mode is an LTE-A mid-frequency band and LTE-A band40, and the third resonant mode is LTE-A band41. The first frequency band is 700-960 MHz. The second frequency band is 1710-2170 MHz and 2300-2400 MHz. The third frequency band is 2500-2690 MHz.

As shown in FIG. 3, in one embodiment, a portion of the second radiating portion A2 has a length L1, and a portion of the third radiating portion A3 has a length L2. The length L1 and the length L2 are 1-10 mm. In one embodiment, the lengths L1 and L2 enhance radiation efficiency of the antenna structure 100.

The coupling portion 16 enhances impedance matching and bandwidth of the antenna structure 100. The coupling portion 16 enhances the bandwidth of the mid and high-frequency bands to achieve carrier aggregation (CA) requirements.

The first radiating section A11 is switched by the switching unit 171 to electrically couple to different switching components 173. Since each switching component 173 has a different impedance, the switching components 173 are switched to adjust the LTE-A low-frequency band. In one embodiment, the switching circuit 17 includes four different switching components 173. The four different switching components 173 are switched to couple to the first radiating section A11 to achieve different LTE-A low-frequency bands, such as LTE-A Band17 (704-746 MHz), LTE-A Band13 (746-787 MHz), LTE-A Band 20 (791-862 MHz), and LTE-A Band8 (880-960 MHz).

Figure 6:
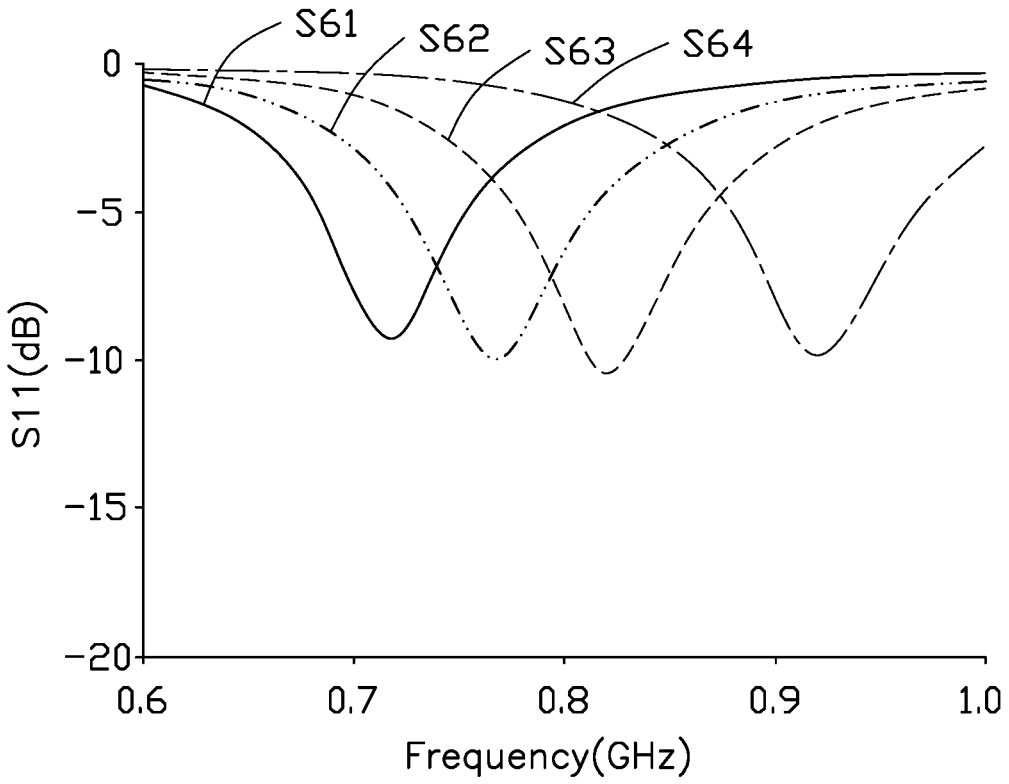
FIG. 6 is a graph of S11 values of an LTE-A low-frequency band.

FIG. 6 shows a graph of scattering values (S11 values) of the LTE-A low-frequency band. A plotline S61 represents S11 values of LTE-A Band17 (704-746 MHz). A plotline S62 represents S11 values of LTE-A Band13 (746-787 MHz). A plotline S63 represents S11 values of LTE-A Band20 (791-862 MHz). A plotline S64 represents S11 values of LTE-A Band8 (880-960 MHz).

Figure 7:
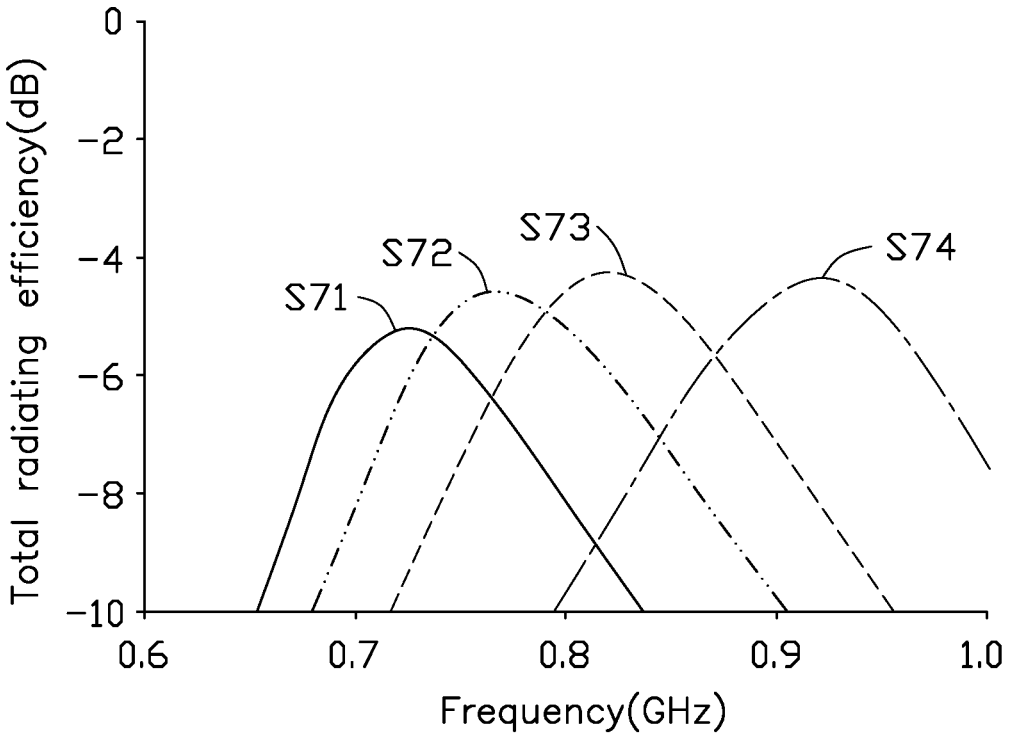
FIG. 7 is a graph of total radiation efficiency of the LTE-A low-frequency band.

FIG. 7 shows a graph of total radiation efficiency of the LTE-A low-frequency band. A plotline S71 represents LTE-A Band17 (704-746 MHz). A plotline S72 represents LTE-A Band13 (746-787 MHz). A plotline S73 represents LTE-A Band20 (791-862 MHz). A plotline S74 represents LTE-A Band8 (880-960 MHz).

Figure 8:
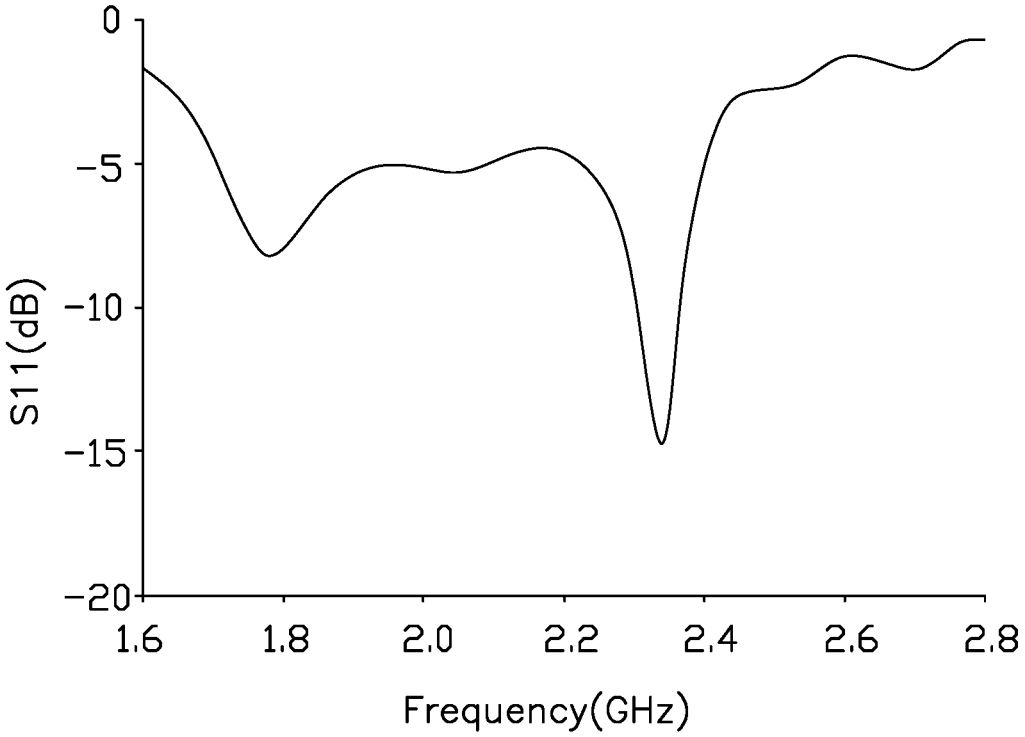
FIG. 8 is a graph of S11 values of the LTE-A mid-frequency and LTE-A Band40 bands.

FIG. 8 shows a graph of S11 values of the LTE-A mid-frequency and LTE-A Band40 bands.

Figure 9:
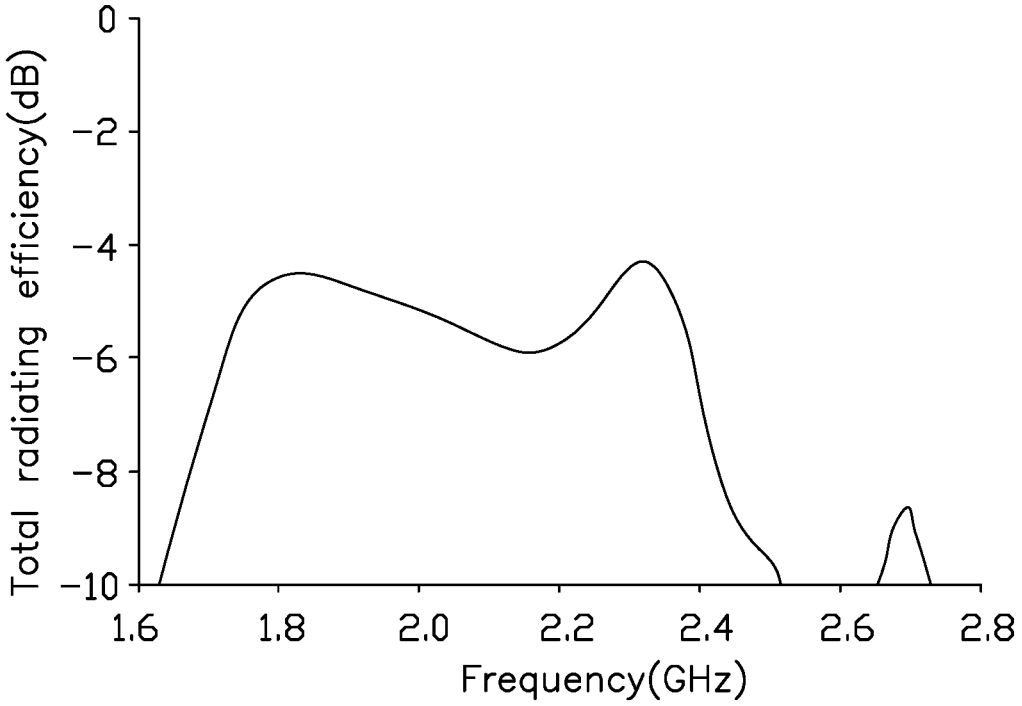
FIG. 9 is a graph of total radiation efficiency of the LTE-A mid-frequency and LTE-A Band40 bands.

FIG. 9 shows a graph of total radiation efficiency of the LTE-A mid-frequency and LTE-A Band40 bands.

Figure 10:
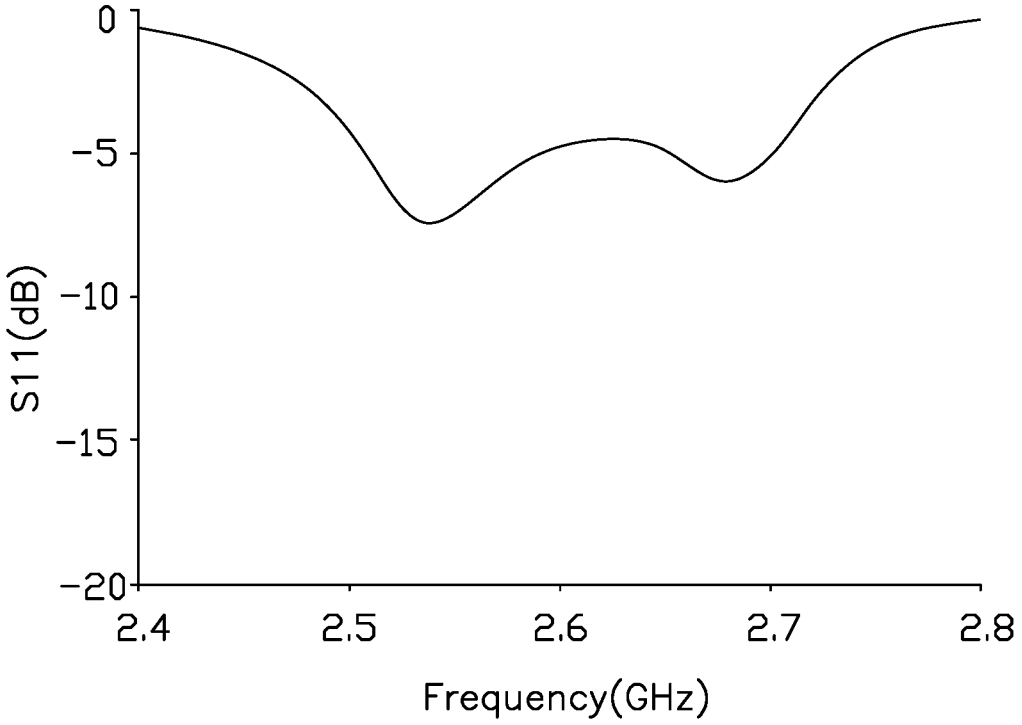
FIG. 10 is a graph of S11 values of LTE-A Band41.

FIG. 10 shows a graph of S11 values of LTE-A Band41.

Figure 11:
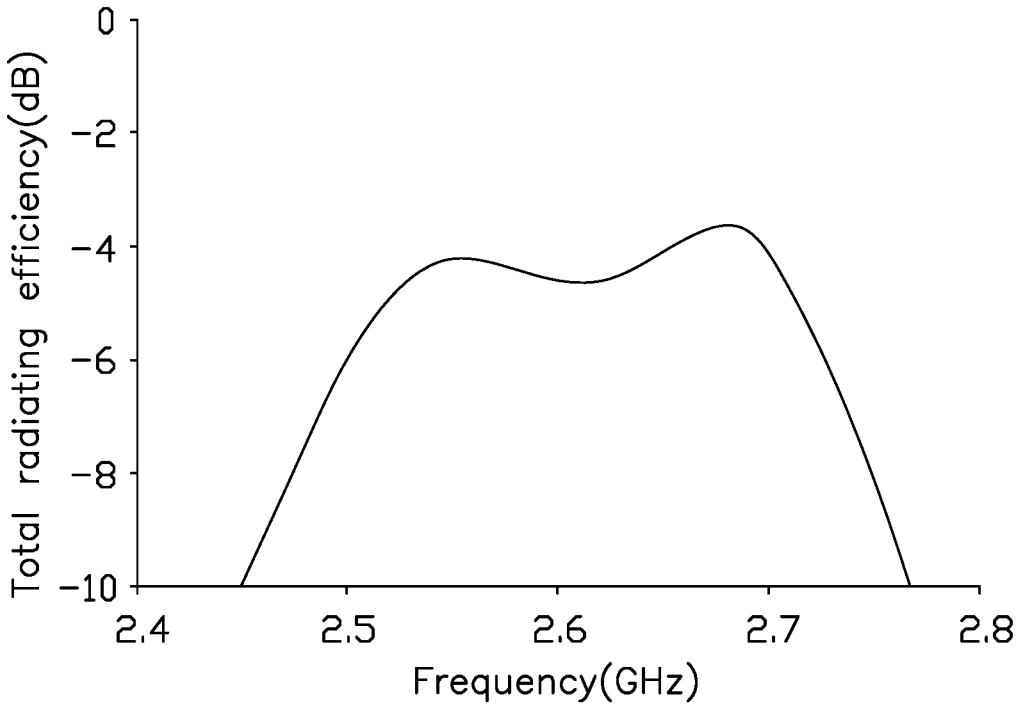
FIG. 11 is a graph of total radiation efficiency of LTE-A Band41.

FIG. 11 shows a graph of total radiation efficiency of LTE-A Band41.

As shown in FIGS. 6 and 7, the low-frequency bands of the antenna structure 100 are excited by the first radiating section A11 and switched by the switching circuit 17. Thus, the low-frequency bands of the antenna structure 100 includes LTE-A Band17 (704-746 MHz), LTE-A Band13 (746-787 MHz), LTE-A Band20 (791-862 MHz), and the LTE-A Band8 (880-960 MHz). As shown in FIGS. 8-11, the second radiating section A12 excites a portion of the mid-high-frequency bands including 1710-2170 MHz and 2300-2400 MHz, and a portion of the high-frequency bands is excited by the metal portion 13 including 2500-2690 MHz.

Furthermore, when the antenna structure 100 operates in LTE-A Band17 (704-746 MHz), LTE-A Band13 (746-787 MHz), LTE-A Band20 (791-862 MHz), and the LTE-A Band8 (880-960 MHz), the LTE-A mid and high-frequency band range is from 1710-2690 MHz. Thus, the switching circuit 17 adjusts the low-frequency bands and does not affect the mid and high-frequency bands to achieve carrier aggregation requirements of LTE-A.

Figure 12:
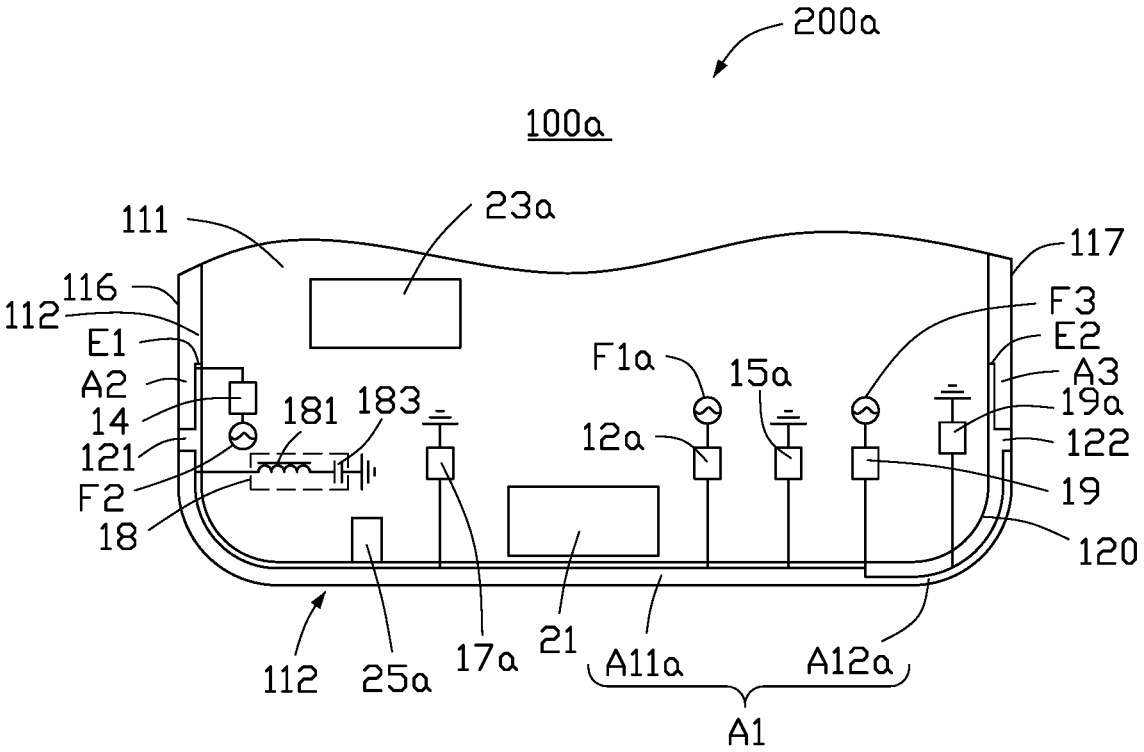
FIG. 12 is a diagram of a second embodiment of an antenna structure.

FIG. 12 shows a second embodiment of an antenna structure 100*a* for use in a wireless communication device 200*a*.

The antenna structure 100*a* includes a middle frame 111, a border frame 112, a first feed source F1*a*, a first matching circuit 12*a*, a second feed source F2, a second matching circuit 14, a short circuit portion 15*a*, and a switching circuit 17*a*. The wireless communication device 200*a* includes a first electronic component 21, a second electronic component 23*a*, and a third electronic component 25*a*.

The border frame 112 includes a slot 120, a first gap 121, and a second gap 122. In one embodiment, the first gap 121 is located on the first side portion 116, and the second gap 117 is located on the second side portion 117. The first gap 121 is defined in the first side portion 116 adjacent to a first endpoint E1 of the slot 120. The second gap 122 is defined in the second side portion 117 adjacent to a second endpoint E2 of the slot 120. The first gap 121 and the second gap 122 substantially face each other. The first gap 121 and the second gap 122 are connected to the slot 120. The slot 120, the first gap 121, and the second gap 122 divide the housing 11 into a first radiating portion A1, a second radiating portion A2, and a third radiating portion A3. In one embodiment, the first radiating portion A1 is a portion of the border frame 112 located between the first gap 121 and the second gap 122. The second radiating portion A2 is a portion of the border frame 112 located between the first gap 121 and the first endpoint E1. The third radiating portion A3 is a portion of the border frame 112 located between the second gap 122 and the second endpoint E2.

One difference between the antenna structure 100*a* and the antenna structure 100 is that in the antenna structure 100*a*, a location of the second electronic component 23*a* and the third electronic component 25*a* is different. Specifically, the second electronic component 23*a* is mounted between the first electronic component 21 and the first gap 121 and is insulated from the slot 120. The third electronic component 25*a* and the second electronic component 23*a* are mounted on a same side of the first electronic component 21, and the third electronic component 25*a* is located between the second electronic component 23*a* and the slot 120. In one embodiment, the third electronic component 25*a* is located adjacent to the first gap 121 and is insulated from the first radiating portion A1 by the slot 120.

Another difference between the antenna structure 100*a* and the antenna structure 100 is that in the antenna structure 100*a*, a location of the first feed source F1*a* is different. Specifically, the first feed source F1*a* is mounted between the first electronic component 21 and the second gap 122 and is adjacent to the first electronic component 21. One end of the first feed source F1*a* is electrically coupled to an end of the first radiating portion A1 through the first matching circuit 12*a* adjacent to the second gap 122 for feeding current signals to the first radiating portion A1. The first matching circuit 12*a* provides a matching impedance between the first feed source F1*a* and the first radiating portion A1. Another difference between the antenna structure 100*a* and the antenna structure 100 is that in the antenna structure 100*a*, the metal portion 13 and the coupling portion 16 are omitted. One end of the second feed source F2 is electrically coupled to an end of the second radiating portion A2 adjacent to the first endpoint E1 for feeding current signals to the second radiating portion A2. The second matching circuit 14 provides a matching impedance between the second feed source F2 and the second radiating portion A2.

Another difference between the antenna structure 100*a* and the antenna structure 100 is that the antenna structure 100*a* further includes a resonance circuit 18. One end of the resonance circuit 18 is electrically coupled to the first radiating portion A1 adjacent to the first gap 121, and a second end of the resonance circuit 18 is coupled to ground. Specifically, the resonance circuit 18 includes a first resonance unit 181 and a second resonance unit 183. One end of the first resonance unit 181 is electrically coupled to an end of the first radiating portion A1 adjacent to the first gap 121. A second end of the first resonance unit 181 is coupled to ground through the second resonance unit 183 in series.

In one embodiment, the first resonance unit 181 is an inductor, and the second resonance unit 183 is a capacitor. In other embodiments, the first resonance unit 181 and the second resonance unit 183 may be other electronic components. The resonance circuit 18 enhances a bandwidth of the high-frequency bands and adjusts a matching impedance of the antenna structure 100*a*.

The antenna structure 100*a* further includes a third feed source F3 and a third matching circuit 19. The third feed source F3 is mounted between the first feed source F1*a* and the second gap 122. One end of the third feed source F3 is electrically coupled to the first radiating portion A1 through the third matching circuit 19 to feed current signals to the first radiating portion A1. The third matching circuit 19 provides a matching impedance between the third feed source F3 and the first radiating portion A1.

The first feed source F1*a* and the third feed source F3 cooperatively divide the first radiating portion A1 into a first radiating section A11*a* and a second radiating section A12*a*. A portion of the border frame 112 between the first feed source F1*a* and the first gap 121 is the first radiating section A11*a*, and a portion of the border frame 112 between the third feed source F3 and the second gap 122 is the second radiating section A12*a*. In one embodiment, a length of the first radiating section A11*a* is longer than a length of the second radiating section A12.

Another difference between the antenna structure 100*a* and the antenna structure 100 is that in the antenna structure 100*a*, a location of the switching circuit 17*a* is different. Specifically, the switching circuit 17*a* is mounted between the first electronic component 21 and the first gap 121. More specifically, the switching circuit 17*a* is mounted between the first electronic component 21 and the third electronic component 25*a*. One end of the switching circuit 17*a* is electrically coupled to the first radiating section A11*a*, and a second end of the switching circuit 17*a* is coupled to ground. The switching circuit 17*a* adjusts a bandwidth of the LTE-A low-frequency bands.

Another difference between the antenna structure 100*a* and the antenna structure 100 is that in the antenna structure 100*a*, a location of the short circuit portion 15*a* is different. Specifically, the short circuit portion 15*a* is mounted between the first electronic component 21 and the second gap 122. More specifically, the short circuit portion 15*a* is mounted between the first feed source F1*a* and the third feed source F3. One end of the short circuit portion 15*a* is electrically coupled to the first radiating portion A1, and a second end of the short circuit portion 15*a* is coupled to ground.

The antenna structure 100*a* further includes a switching module 19*a*. The switching module 19*a* is mounted between the third feed source F3 and the second gap 122 adjacent to the second gap 122. One end of the switching module 19*a* is electrically coupled to the second radiating section A12*a*, and a second end of the switching module 19*a* is coupled to ground. The switching module 19*a* adjusts a frequency of the LTE-A mid-frequency bands. A structure of the switching module 19*a* is similar to a structure of the switching circuit 17*a*.

In one embodiment, a width of the slot 120 between the third feed source F3 and the second gap 122 is greater than a width of the slot 120 at any other location. Thus, a width of the second radiating section A12*a* is less than a width of any other portion of the first radiating portion A1, including the first radiating section A11*a*.

Figure 13:
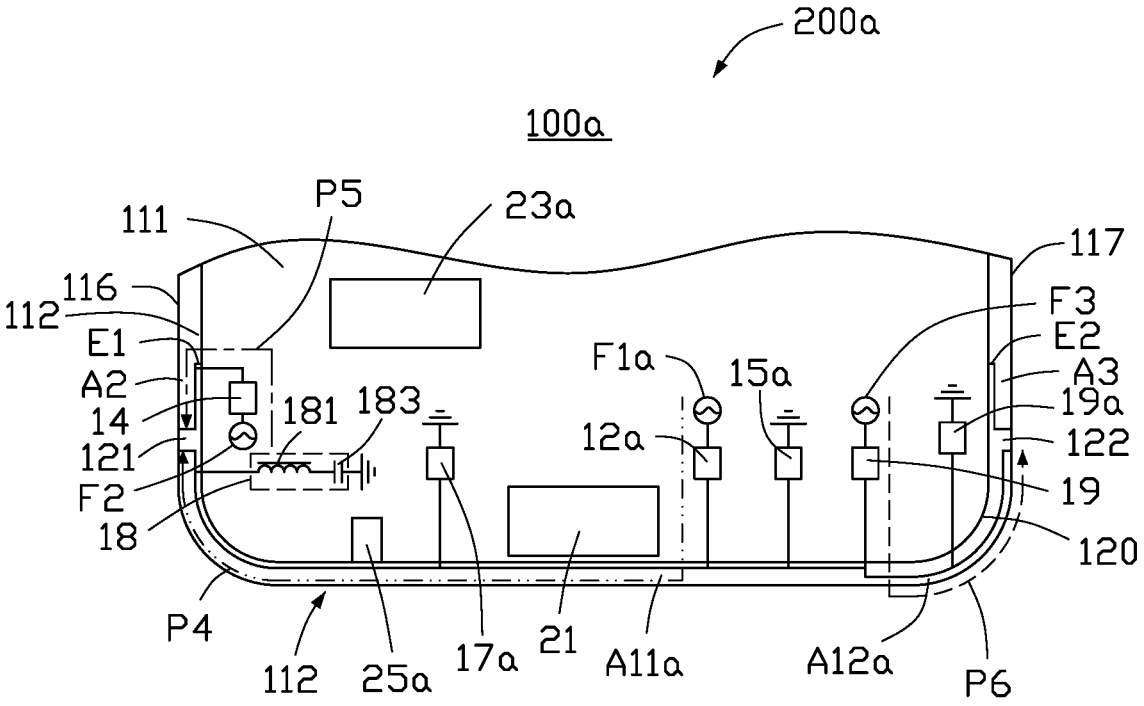
FIG. 13 is a diagram of current paths of the antenna structure in FIG. 12.

As shown in FIG. 13, when the first feed source F1*a* supplies an electric current, the electric current from the first feed source F1*a* flows along a current path P4 through the first matching circuit 12*a* and the first radiating section A11*a* toward the first gap 121, and then is coupled to ground through the switching circuit 17*a*. Thus, the first radiating section A11*a* forms a PIFA antenna to excite a first resonant mode and generate a radiation signal in a first frequency band.

When the second feed source F2 supplies an electric current, the electric current from the second feed source F2 flows along a current path P5 through the second matching circuit 14 and the second radiating portion A2. Thus, the second radiating portion A2 forms a loop antenna to excite a second resonant mode and generate a radiation signal in a second frequency band.

When the third feed source F3 supplies an electric current, the electric current from the third feed source F3 flows along a current path P6 through the third matching circuit 19 and the second radiating section A12*a*. Thus, the second radiating section A12*a* forms a PIFA antenna to excite a third resonant mode and generate a radiation signal in a third frequency band.

In one embodiment, the first resonant mode is a long term evolution advanced (LTE-A) low-frequency band, the second resonant mode is an LTE-A high-frequency band, and the third resonant mode is an LTE-A mid-frequency band. The first frequency band is 700-960 MHz. The second frequency band is 2300-2690 MHz. The third frequency band is 1710-2170 MHz.

Figure 14:
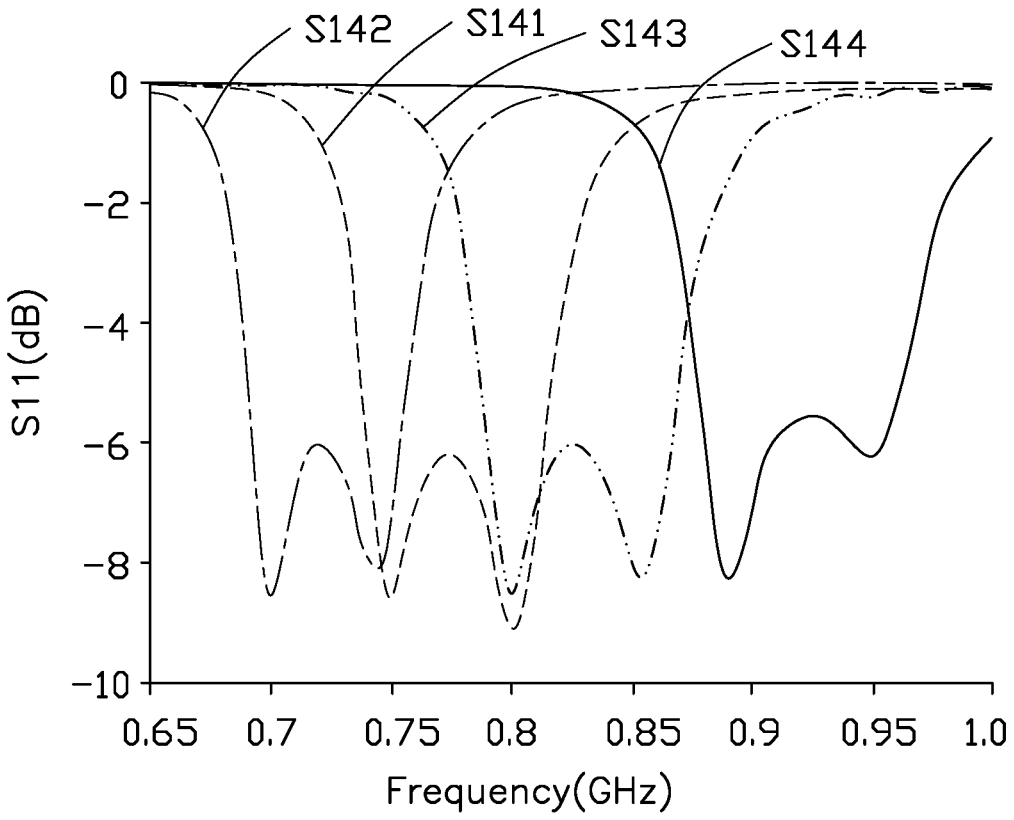
FIG. 14 is a graph of S11 values of the LTE-A low-frequency band.

FIG. 14 shows a graph of scattering values (S11 values) of the LTE-A low-frequency band. A plotline S141 represents S11 values of LTE-A Band17 (704-746 MHz). A plotline S142 represents S11 values of LTE-A Band13 (746-787 MHz). A plotline S143 represents S11 values of LTE-A Band20 (791-862 MHz). A plotline S144 represents S11 values of LTE-A Band8 (880-960 MHz).

Figure 15:
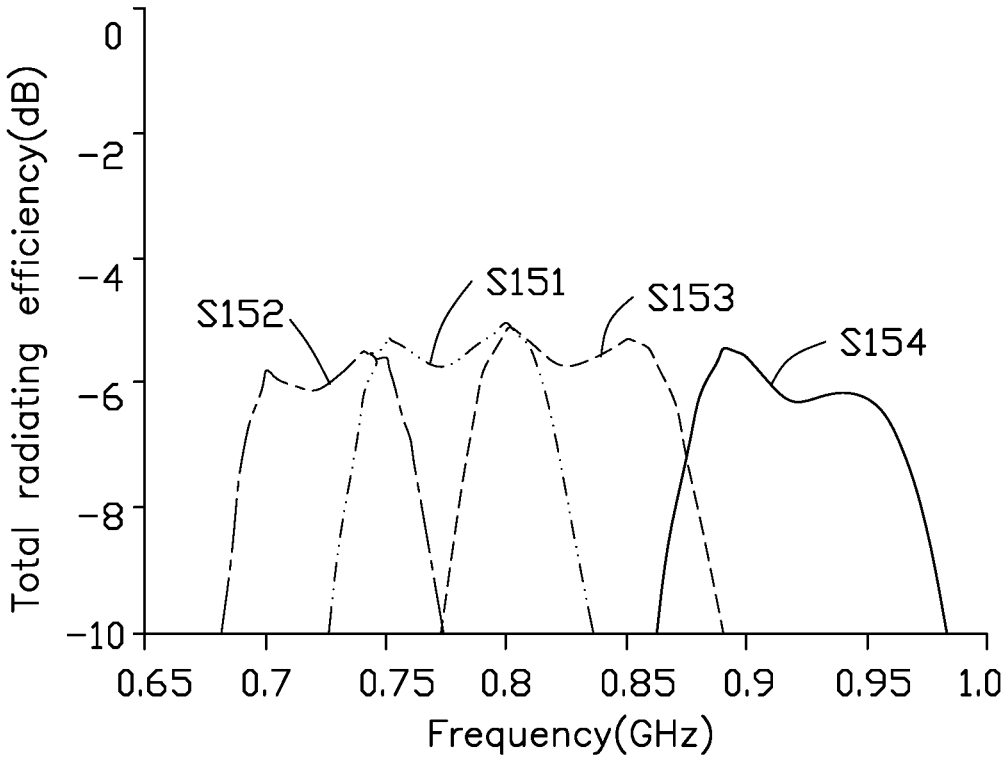
FIG. 15 is a graph of total radiation efficiency of the LTE-A low-frequency band.

FIG. 15 shows a graph of total radiation efficiency of the LTE-A low-frequency band. A plotline S151 represents LTE-A Band17 (704-746 MHz). A plotline S152 represents LTE-A Band13 (746-787 MHz). A plotline S153 represents LTE-A Band20 (791-862 MHz). A plotline S154 represents LTE-A Band8 (880-960 MHz).

Figure 16:
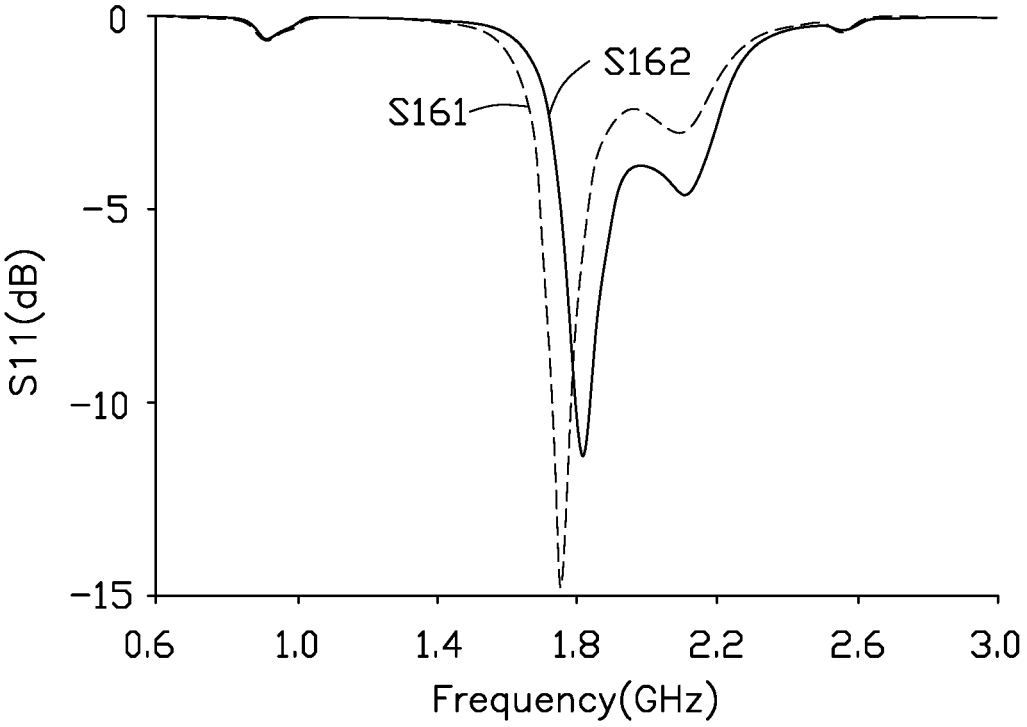
FIG. 16 is a graph of S11 values of the LTE-A mid-frequency band.

FIG. 16 shows a graph of S11 values of the LTE-A mid-frequency band. A plotline S161 represents S11 values when the switching module 19*a* switches to a switching component having a capacitance of 0.06 pF and the switching module 19*a* switches to bandwidth B2 and B3 (1710-1880 MHz). A plotline S162 represents S11 values when the switching module 19*a* switches to a switching component having an inductance of 140 nH and the switching module 19*a* switches to bandwidth B1 and B2 (1850-2170 MHz).

Figure 17:
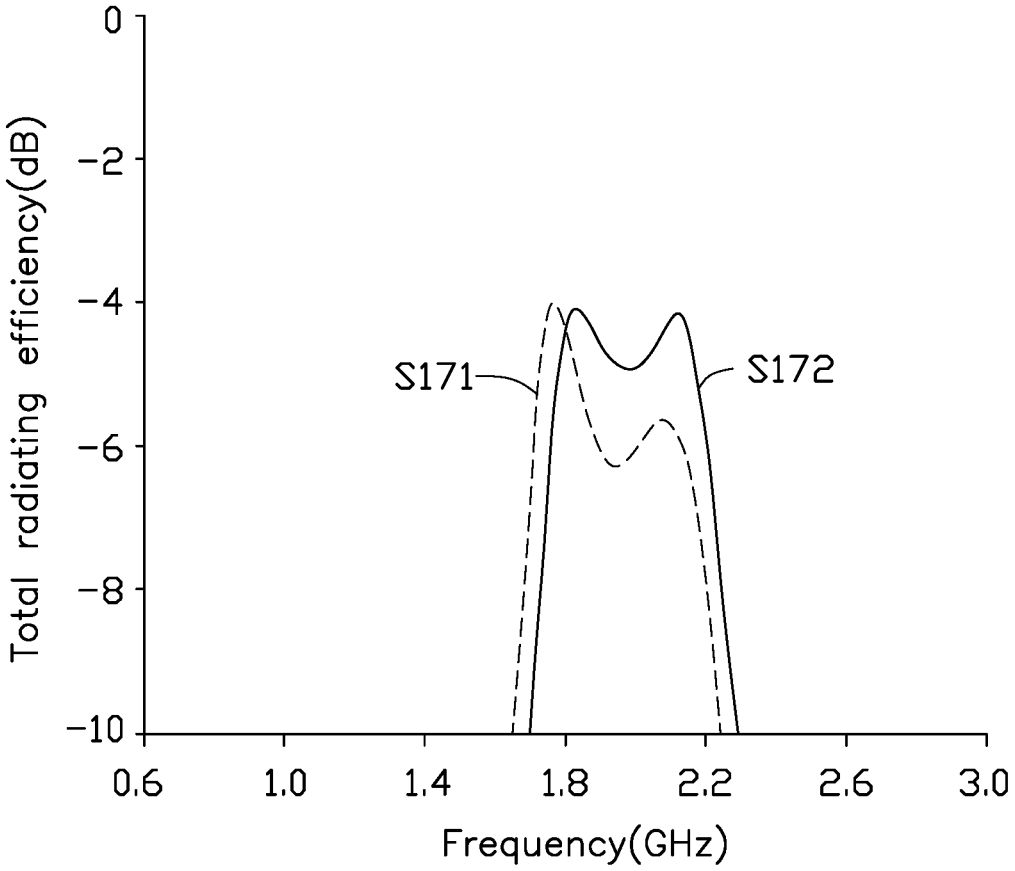
FIG. 17 is a graph of total radiation efficiency of the LTE-A mid-frequency band.

FIG. 17 shows a graph of total radiation efficiency of the LTE-A mid-frequency band. A plotline S171 represents a total radiation efficiency when the switching module 19*a* switches to a switching component having a capacitance of 0.06 pF and the switching module 19*a* switches to bandwidth B2 and B3 (1710-1880 MHz). A plotline S172 represents a total radiation efficiency when the switching module 19*a* switches to a switching component having an inductance of 140 nH and the switching module 19*a* switches to bandwidth B1 and B2 (1850-2170 MHz).

As shown in FIGS. 14-17, the low-frequency mode is excited by the switching circuit 17*a*, and the mid-frequency mode is excited by the switching module 19*a*. Furthermore, the switching module 19*a* switches the mid-frequency band of the antenna structure 100*a* to LTE-A band2 and LTE-A band3 (1710-1880 MHz), LTE-A band1 and LTE-A band2 (1850-2170 MHz), thereby operating at 1710-2170 MHz.

Figure 18:
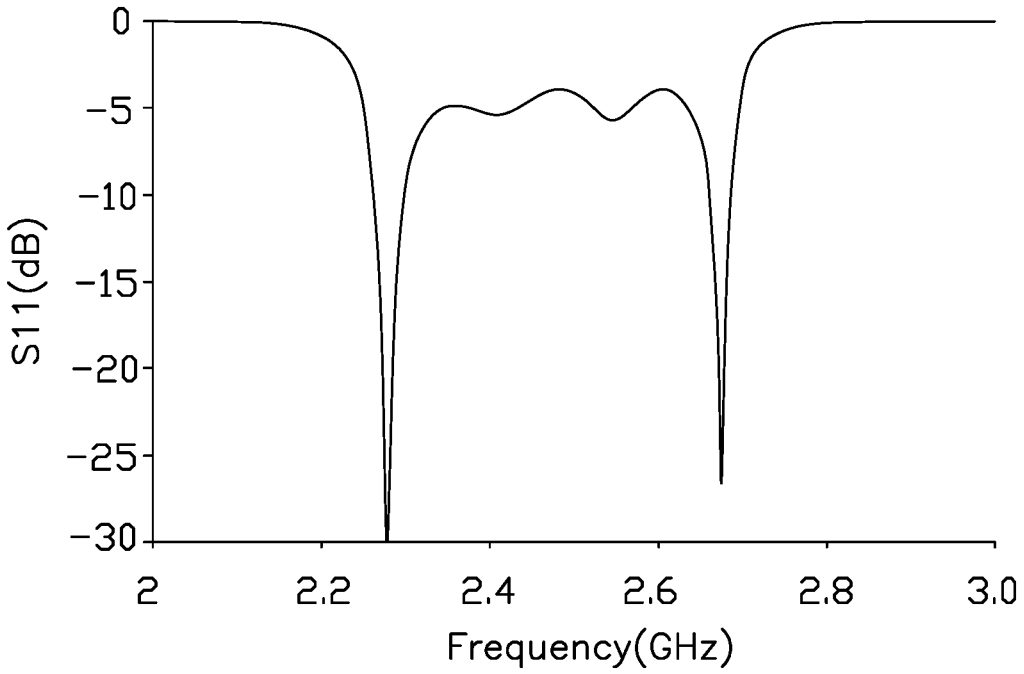
FIG. 18 is a graph of S11 values of the LTE-A high-frequency band.

FIG. 18 shows a graph of S11 values of the LTE-A high-frequency band.

Figure 19:
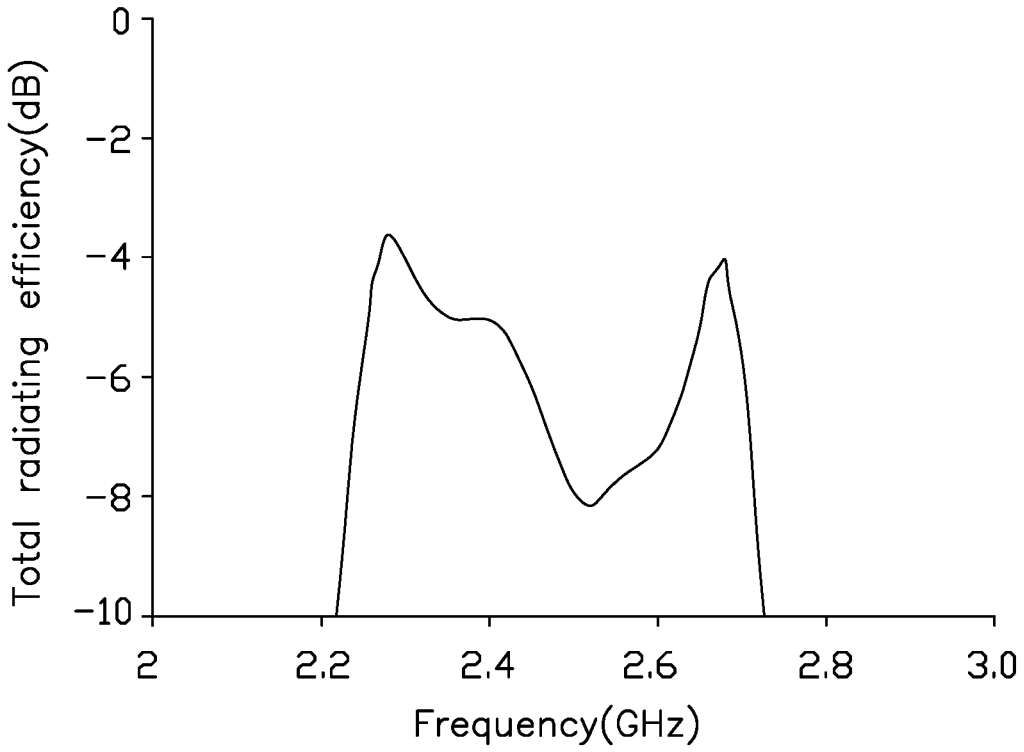
FIG. 19 is a graph of total radiation efficiency of the LTE-A high-frequency band.

FIG. 19 shows a graph of total radiation efficiency of the LTE-A high-frequency band.

As shown in FIGS. 14 and 15, the low-frequency bands of the antenna structure 100*a* are excited by the first radiating section A11*a* and switched by the switching circuit 17*a*. Thus, the low-frequency bands of the antenna structure 100 includes LTE-A Band17 (704-746 MHz), LTE-A Band13 (746-787 MHz), LTE-A Band20 (791-862 MHz), and the LTE-A Band8 (880-960 MHz). As shown in FIGS. 16-17, the second radiating section A12*a* excites the mid-frequency bands including LTE-A 1710-2170 MHz. As shown in FIGS. 18-19, the second radiating portion A2 excites the high-frequency bands including LTE-A 2300-2690 MHz.

Furthermore, when the antenna structure 100 operates in LTE-A Band17 (704-746 MHz), LTE-A Band13 (746-787 MHz), LTE-A Band20 (791-862 MHz), and the LTE-A Band8 (880-960 MHz), the LTE-A mid and high-frequency band range is from 1710-2690 MHz. Thus, the switching circuit 17*a* adjusts the low-frequency bands and does not affect the mid and high-frequency bands to achieve carrier aggregation requirements of LTE-A. Also, the switching module 19*a* adjusts the mid-frequency bands and does not affect the low and high-frequency bands to achieve carrier aggregation requirements of LTE-A.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, the first gap and the second gap are in the border frame, the slot, the first gap, and the second gap divide the border frame into a first radiating portion, the first radiating portion is insulated from the middle frame by the slot;

a plurality of ground points for coupling to ground;

a first feed source electrically coupled to the first radiating portion and adapted to provide an electric current to the first radiating portion; wherein:

a thickness of the border frame is greater than or equal to twice a width of the first gap or twice a width of the second gap; and a width of the slot is less than or equal to half the width of the first gap and the width of the slot is less than or equal to half the width of the second gap.

2. The antenna structure of claim 1, wherein:

the border frame comprises an end portion, a first side portion, and a second side portion;

the first side portion and the second side portion are respectively coupled to opposite ends of the end portion;

the slot is defined in an inner side of the end portion and extends toward the first side portion and the second side portion;

the first gap is defined in the first side portion and is adjacent to a first endpoint of the slot;

the second gap is defined in the second side portion and is adjacent to a second endpoint of the slot;

a portion of the border frame located between the first gap and the second gap is defined as the first radiating portion;

a portion of the border frame located between the first gap and the first endpoint of the first side portion is defined as a second radiating portion.

3. The antenna structure of claim 2 further comprising a metal portion and a second feed source, wherein:

one end of the metal portion is electrically coupled to the second radiating portion, and a second end of the metal portion extends along the slot;

one end of the second feed source is electrically coupled to the metal portion for feeding electric current to the metal portion;

a portion of the border frame between the first feed source and the second gap is defined as a first radiating section;

a portion of the border frame between the first feed source and the first gap is defined as a second radiating section;

when the first feed source supplies an electric current, the electric current from the first feed source flows through the first radiating section toward the second gap to excite a first resonant mode and generate a radiating signal in a first frequency band;

electric current from the first feed source flows through the second radiating section toward the first gap to excite a second resonant mode and generate a radiation signal in a second frequency band;

when the second feed source supplies an electric current, the electric current from the second feed source flows through the metal portion to excite a third resonant mode and generate a radiation signal in a third frequency band.

4. The antenna structure of claim 3, wherein:

the first resonant mode is a long term evolution advanced (LTE-A) low-frequency mode;

the second resonant mode is an LTE-A mid-frequency mode and an LTE-A band40 frequency mode;

the third resonant mode is an LTE-A band41 frequency mode.

5. The antenna structure of claim 3 further comprising a short circuit portion made of metal, wherein:

one end of the short circuit portion is electrically coupled to the second radiating section, and a second end of the short circuit portion is coupled to ground.

6. The antenna structure of claim 3 further comprising a coupling portion, wherein:

one end of the coupling portion is electrically coupled to the first radiating section, and a second end of the coupling portion is electrically coupled to ground; and the coupling portion is an inductor, a capacitor, or a combination of the two.

7. The antenna structure of claim 2 further comprising a second feed source and a third feed source, wherein:

one end of the second feed source is electrically coupled to an end of the second radiating portion adjacent to the first endpoint for feeding current signals to the second radiating portion;

the third feed source is mounted between the first feed source and the second gap;

one end of the third feed source is electrically coupled to the first radiating portion for feeding current signals to the first radiating portion;

a portion of the border frame between the first feed source and the first gap is defined as a first radiating section;

a portion of the border frame between the third feed source and the second gap is defined as a second radiating section;

when the first feed source supplies an electric current, the electric current from the first feed source flows through the first radiating section to excite a first resonant mode and generate a radiation signal in a first frequency band;

when the second feed source supplies an electric current, the electric current from the second feed source flows through the second radiating portion to excite a second resonant mode and generate a radiation signal in a second frequency band;

when the third feed source supplies an electric current, the electric current from the third feed source flows through the second radiating section to excite a third resonant mode and generate a radiation signal in a third frequency band.

8. The antenna structure of claim 7, wherein:

the first resonant mode is an LTE-A low-frequency band;

the second resonant mode is an LTE-A high-frequency band; and the third resonant mode is an LTE-A mid-frequency band.

9. The antenna structure of claim 7 further comprising a resonance circuit comprising a first resonance unit and a second resonance unit, wherein:

one end of the first resonance unit is electrically coupled to an end of the first radiating portion adjacent to the first gap, and a second end of the first resonance unit is coupled to ground through the second resonance unit in series.

10. The antenna structure of claim 7 further comprising a short circuit portion made of metal, wherein:

the short circuit portion is mounted between the first feed source and the third feed source;

one end of the short circuit portion is electrically coupled to the first radiating portion, and a second end of the short circuit portion is coupled to ground.

11. The antenna structure of claim 7 further comprising a switching module, wherein:

the switching module is mounted between the third feed source and the second gap and is adjacent to the second gap;

one end of the switching module is electrically coupled to the second radiating section, and a second end of the switching module is coupled to ground;

the switching module is adapted to adjust a frequency of the LTE-A mid-frequency band.

12. The antenna structure of claim 7, wherein:

a width of the slot between the third feed source and the second gap is greater than a width of the slot at any other location.

13. The antenna structure of claim 7 further comprising a switching circuit comprising a switching unit and a plurality of switching components, wherein:

the switching unit is electrically coupled to the first radiating section;

the plurality of switching components are coupled together in parallel;

one end of each of the plurality of switching components is electrically coupled to the switching unit, and a second end of each of the plurality of switching components is coupled to ground;

the switching unit is adapted to electrically couple one of the plurality of switching components or a combination thereof to the first radiating section thereby adjusting a frequency of the LTE-A low-frequency band.

14. A wireless communication device comprising an antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, the first gap and the second gap are in the border frame, the slot, the first gap, and the second gap divide the border frame into a first radiating portion, the first radiating portion is insulated from the middle frame by the slot;

a plurality of ground points for coupling to ground;

a first feed source electrically coupled to the first radiating portion and adapted to provide an electric current to the first radiating portion; wherein:

a thickness of the border frame is greater than or equal to twice a width of the first gap or twice a width of the second gap; and a width of the slot is less than or equal to half the width of the first gap and the width of the slot is less than or equal to half the width of the second gap.

15. The wireless communication device of claim 14, wherein:

the border frame comprises an end portion, a first side portion, and a second side portion;

the first side portion and the second side portion are respectively coupled to opposite ends of the end portion;

the slot is defined in an inner side of the end portion and extends toward the first side portion and the second side portion;

the first gap is defined in the first side portion and is adjacent to a first endpoint of the slot;

the second gap is defined in the second side portion and is adjacent to a second endpoint of the slot;

a portion of the border frame located between the first gap and the second gap is defined as the first radiating portion;

a portion of the border frame located between the first gap and the first endpoint of the first side portion is defined as a second radiating portion.

16. The wireless communication device of claim 15, wherein:

the antenna structure further comprises a metal portion and a second feed source;

one end of the metal portion is electrically coupled to the second radiating portion, and a second end of the metal portion extends along the slot;

one end of the second feed source is electrically coupled to the metal portion for feeding electric current to the metal portion;

a portion of the border frame between the first feed source and the second gap is defined as a first radiating section;

a portion of the border frame between the first feed source and the first gap is defined as a second radiating section;

when the first feed source supplies an electric current, the electric current from the first feed source flows through the first radiating section toward the second gap to excite a first resonant mode and generate a radiating signal in a first frequency band;

electric current from the first feed source flows through the second radiating section toward the first gap to excite a second resonant mode and generate a radiation signal in a second frequency band;

when the second feed source supplies an electric current, the electric current from the second feed source flows through the metal portion to excite a third resonant mode and generate a radiation signal in a third frequency band.

17. The wireless communication device of claim 16, wherein:

the antenna structure further comprises a short circuit portion made of metal; and one end of the short circuit portion is electrically coupled to the second radiating section, and a second end of the short circuit portion is coupled to ground.

18. The wireless communication device of claim 16, wherein:

the antenna structure further comprises a coupling portion;

one end of the coupling portion is electrically coupled to the first radiating section, and a second end of the coupling portion is electrically coupled to ground; and the coupling portion is an inductor, a capacitor, or a combination of the two.

19. The wireless communication device of claim 15, wherein:

the antenna structure further comprises a second feed source and a third feed source;

one end of the second feed source is electrically coupled to an end of the second radiating portion adjacent to the first endpoint for feeding current signals to the second radiating portion;

the third feed source is mounted between the first feed source and the second gap;

one end of the third feed source is electrically coupled to the first radiating portion for feeding current signals to the first radiating portion;

a portion of the border frame between the first feed source and the first gap is defined as a first radiating section;

a portion of the border frame between the third feed source and the second gap is defined as a second radiating section;

electric current from the first feed source flows through the first radiating section to excite a first resonant mode and generate a radiation signal in a first frequency band;

electric current from the second feed source flows through the second radiating portion to excite a second resonant mode and generate a radiation signal in a second frequency band;

electric current from the third feed source flows through the second radiating section to excite a third resonant mode and generate a radiation signal in a third frequency band.

20. The wireless communication device of claim 19, wherein:

the antenna structure further comprises a resonance circuit comprising a first resonance unit and a second resonance unit; and one end of the first resonance unit is electrically coupled to an end of the first radiating portion adjacent to the first gap, and a second end of the first resonance unit is coupled to ground through the second resonance unit in series.

* * * * *